US006921856B2

(12) United States Patent
Koseki

(10) Patent No.: US 6,921,856 B2
(45) Date of Patent: Jul. 26, 2005

(54) PERFORMANCE TONE PROVIDING APPARATUS, PERFORMANCE TONE PROVIDING SYSTEM, COMMUNICATION TERMINAL FOR USE IN THE SYSTEM, PERFORMANCE TONE PROVIDING METHOD, PROGRAM FOR IMPLEMENTING THE METHOD, AND STORAGE MEDIUM STORING THE PROGRAM

(75) Inventor: Shinya Koseki, Shizuoka-ken (JP)

(73) Assignee: Yamaha Corporation, Shizuoka-Ken (JP)

( * ) Notice: Subject to any disclaimer, the term of this patent is extended or adjusted under 35 U.S.C. 154(b) by 133 days.

(21) Appl. No.: 10/397,008

(22) Filed: Mar. 25, 2003

(65) Prior Publication Data

US 2003/0177886 A1 Sep. 25, 2003

(30) Foreign Application Priority Data

Mar. 25, 2002 (JP) ..... 2002-084273

(51) Int. Cl.[7] ..... G10H 7/00
(52) U.S. Cl. ..... 84/603; 84/609
(58) Field of Search ..... 84/600, 602, 603, 84/609, 645

(56) References Cited

U.S. PATENT DOCUMENTS

| | | | | | |
|---|---|---|---|---|---|
| 5,159,140 | A | * | 10/1992 | Kimpara et al. | 84/600 |
| 5,345,035 | A | * | 9/1994 | Yamada | 84/622 |
| 5,464,946 | A | * | 11/1995 | Lewis | 84/609 |
| 5,637,822 | A | * | 6/1997 | Utsumi et al. | 84/645 |
| 5,908,997 | A | * | 6/1999 | Arnold et al. | 84/615 |
| 6,069,310 | A | * | 5/2000 | James | 84/645 |
| 6,288,317 | B1 | * | 9/2001 | Willis | 84/600 |
| 6,482,087 | B1 | | 11/2002 | Egozy et al. | |

* cited by examiner

*Primary Examiner*—Jeffrey W Donels
(74) *Attorney, Agent, or Firm*—Harness, Dickey & Pierce, PLC

(57) ABSTRACT

There is provided a performance tone providing apparatus that enables the user to listen to musical tones sounded from a desired musical instrument according to his/her performing operation even if the desired musical instrument does not exist in the vicinity of the user. Musical tone data including data specifying pitches of musical tones is received from a communication terminal. A CPU causes a predetermined musical instrument to carry out automatic performance based on the received musical tone data. Performance tone data representative of musical tones sounded from the predetermined musical instrument by the automatic performance is transmitted to a communication terminal.

29 Claims, 11 Drawing Sheets

*FIG. 5*

USAGE CONDITION CONFIRMATION SCREEN

■ ANOTHER USER IS USING NOW.
PLEASE WAIT FOR A WHILE.
NOTE THAT USERS AT FOLLOWING
SHOPS ARE ALSO WAITING FOR PLAY.

<WAITING FOR PLAY>

1. SHOP 003
2. SHOP 007

PERFORMANCE TONE PROVIDING APPARATUS, PERFORMANCE TONE PROVIDING SYSTEM, COMMUNICATION TERMINAL FOR USE IN THE SYSTEM, PERFORMANCE TONE PROVIDING METHOD, PROGRAM FOR IMPLEMENTING THE METHOD, AND STORAGE MEDIUM STORING THE PROGRAM

BACKGROUND OF THE INVENTION

1. Field of the Invention

The present invention relates to a performance tone providing apparatus, performance tone providing system, and performance tone providing method that provide musical tones sounded from predetermined musical instruments for the user, and a communication terminal used in the performance tone providing system, and a program for implementing the performance tone providing method, as well as a storage medium storing the program.

2. Description of the Related Art

A wide variety of musical instruments have been provided in the field of music for long times. These musical instruments enable users to enjoy performance by listening to musical tones sounded from the musical instruments according to their performing operations.

However, to enjoy performance by a desired musical instrument, a musical instrument that may be freely used by the user needs to really exist in the vicinity of the user. Thus, to satisfy the user's requirement to play a desired musical instrument, he/she needs to purchase or borrow the musical instrument. On the other hand, it is possible for the user to play a desired musical instrument if he/she comes to a musical instrument shop where a number of musical instruments are displayed. However, due to limitations of musical instrument display space in a musical instrument shop, limitations are inevitably imposed on the types of musical instruments to be displayed in the shop, and therefore, the user cannot always play a desired musical instrument.

SUMMARY OF THE INVENTION

It is therefore an object of the present invention to provide a performance tone providing apparatus, performance tone providing system, and performance tone providing method that enable the user to listen to musical tones sounded from a desired musical instrument according to his/her performing operation even if the desired musical instrument does not exist in the vicinity of the user, and a communication terminal used in the system, and a program for implementing the performance tone providing method, as well as a storage medium storing the program.

To attain the above object, in a first aspect of the present invention, there is provided a performance tone providing apparatus comprising a receiving device that receives musical tone data including data specifying pitch of musical tones from a first communication terminal, a controller that causes a predetermined musical instrument to carry out automatic performance based on the musical tone data received by the receiving device, and a transmitting device that transmits performance tone data representative of musical tones sounded from the predetermined musical instrument by the automatic performance, to a second communication terminal.

Preferably, the transmitting device transmits the performance tone data representative of musical tones sounded from a musical instrument designated by the first communication terminal among a plurality of musical instruments prepared in advance.

Preferably, the plurality of musical instruments comprise automatic performance pianos.

Preferably, each time the receiving device receives the musical tone data from the first communication terminal, the controller causes the predetermined musical instrument to carry out automatic performance based on the received musical tone data.

Preferably, the second communication terminal is identical with the first communication terminal.

Preferably, the second communication terminal is different from the first communication terminal.

Preferably, the predetermined musical instrument is a natural musical instrument, and the performance tone data comprises digital audio data generated by A/D conversion from acoustic tones generated by the automatic performance of the predetermined musical instrument.

Preferably, the second communication terminal reproduces the performance tone data as audio data.

To attain the above object, in a second aspect of the present invention, there is provided a communication terminal comprising a transmitting device that transmits musical tone data including data specifying pitch of musical tones to a performance tone providing apparatus, and a receiving device that receives performance tone data representative of musical tones sounded from a predetermined musical instrument when the predetermined musical instrument is caused to carry out automatic performance based on the musical tone data transmitted from the transmitting device, from the performance tone providing apparatus.

Preferably, the predetermined musical instrument comprises an automatic performance piano.

Preferably, a controller that provides control such that the performance tone data received by the receiving device is supplied to a tone outputting device capable of outputting musical tones according to the performance tone data.

Preferably, the transmitting device transmits musical tone data outputted from an electronic musical instrument that generates the musical tone data including data specifying pitch of musical tones according to a user's operations, to the performance tone providing apparatus.

Preferably, the predetermined musical instrument is a natural musical instrument, and the performance tone data comprises digital audio data generated from acoustic tones generated by the automatic performance of the predetermined musical instrument.

Preferably, the communication terminal reproduces the performance tone data as audio data.

To attain the above object, in a third aspect of the present invention, there is provided a performance tone providing system comprising an electronic musical instrument that outputs musical tone data including data specifying pitch of musical tones according to user's operations, a first communication terminal that transmits the musical tone data outputted from the electronic musical instrument, a musical instrument that carries out automatic performance based on musical tone data, a tone collecting device that generates performance tone data representative of musical tones sounded from the musical instrument, and a performance tone providing apparatus that causes the musical instrument to carry out the automatic performance based on the musical tone data transmitted from the communication terminal, and transmits the performance tone data generated by the tone collecting device according to the automatic performance to a second communication terminal.

Preferably, the second communication terminal is identical with the first communication terminal.

Preferably, the second communication terminal is different from the first communication terminal.

To attain the above object, in a fourth aspect of the present invention, there is provided a performance tone providing method executed by a computer, which communicates with first and second communication terminals, comprising a receiving step of receiving musical tone data including data specifying pitch of musical tones from the first communication terminal, an automatic performance step of causing a predetermined musical instrument to carry out automatic performance based on the musical tone data received in the receiving step, and a transmitting step of transmitting performance tone data representing tones sounded from the predetermined musical instrument in the automatic performance step, to the second communication terminal.

Preferably, the transmitting step comprises transmitting the performance data representative of musical tones sounded from a musical instrument designated by the first communication terminal among a plurality of musical instruments prepared in advance.

Preferably, the plurality of musical instruments comprise automatic performance pianos.

Preferably, each time the musical tone data is received from the first communication terminal in the receiving step, in the automatic performance step the predetermined musical instrument is caused to carry out automatic performance based on the received musical tone data.

Preferably, the second communication terminal is identical with the first communication terminal.

Preferably, the second communication terminal is different from the first communication terminal.

Preferably, the predetermined musical instrument is a natural musical instrument, and the performance tone data comprises digital tone data generated by A/D conversion from acoustic tones generated by the automatic performance of the predetermined musical instrument.

Preferably, the second communication terminal reproduces the performance tone data as audio data.

To attain the above object, in a fifth aspect of the present invention, there is provided a program executed by a computer, which communicates with first and second communication terminals, comprising a receiving module for receiving musical tone data including data specifying pitch of musical tones from the first communication terminal, an automatic performance module for causing a predetermined musical instrument to carry out automatic performance based on the received musical tone data, and a transmitting module for transmitting performance tone data representative of musical tones sounded from the predetermined musical instrument by the automatic performance module, to the second communication terminal.

To attain the above object, in a sixth aspect of the present invention, there is provided a program that is executed by a computer, which communicates with a performance tone providing apparatus, comprising a transmitting module for transmitting musical tone data including data specifying pitch of musical tones to the performance tone providing apparatus, and a receiving module for receiving performance tone data representative of musical tones sounded from a predetermined musical instrument when the predetermined musical instrument is caused to carry out automatic performance based on the transmitted musical tone data, from the automatic performance providing apparatus.

To attain the above object, in a seventh aspect of the present invention, there is provided a computer-readable storage medium storing a program executed by a computer, which communicates with a performance tone providing apparatus, comprising a receiving module for receiving musical tone data including data specifying pitch of musical tones from a first communication terminal, an automatic performance module for causing a predetermined musical instrument to carry out automatic performance based on the received musical tone data, and a transmitting module for transmitting performance tone data representative of tones sounded from the predetermined musical instrument by the automatic performance module, to a second communication terminal.

To attain the above object, in an eighth aspect of the present invention, there is provided a computer-readable storage medium storing a program that is executed by a computer, which communicates with a performance tone providing apparatus, comprising a transmitting module for transmitting musical tone data including data specifying pitch of musical tones to the performance tone providing apparatus, and a receiving module for receiving performance tone data representing tones sounded from a predetermined musical instrument when the predetermined musical instrument is caused to carry out automatic performance based on the transmitted musical tone data, from the automatic performance providing apparatus.

According to the present invention, even if a musical instrument desired to be played does not exist in the vicinity of the user, he/she can listen to musical tones sounded from the desired musical instrument based on his/her performing operation.

The above and other objects, features, and advantages of the invention will become more apparent from the following detailed description taken in conjunction with the accompanying drawings.

BRIEF DESCRIPTION OF THE DRAWINGS

FIG. 5 is a view showing the contents of a usage condition confirmation screen in the performance tone providing system in FIG. 1;

DETAILED DESCRIPTION OF THE PREFERRED EMBODIMENTS

The present invention will now be described in detail with reference to the drawings showing preferred embodiments thereof. It is to be understood that there is no intention to limit the invention to the following embodiments, but certain changes and modifications may be possible within the scope of the appended claims.

Figure 1:
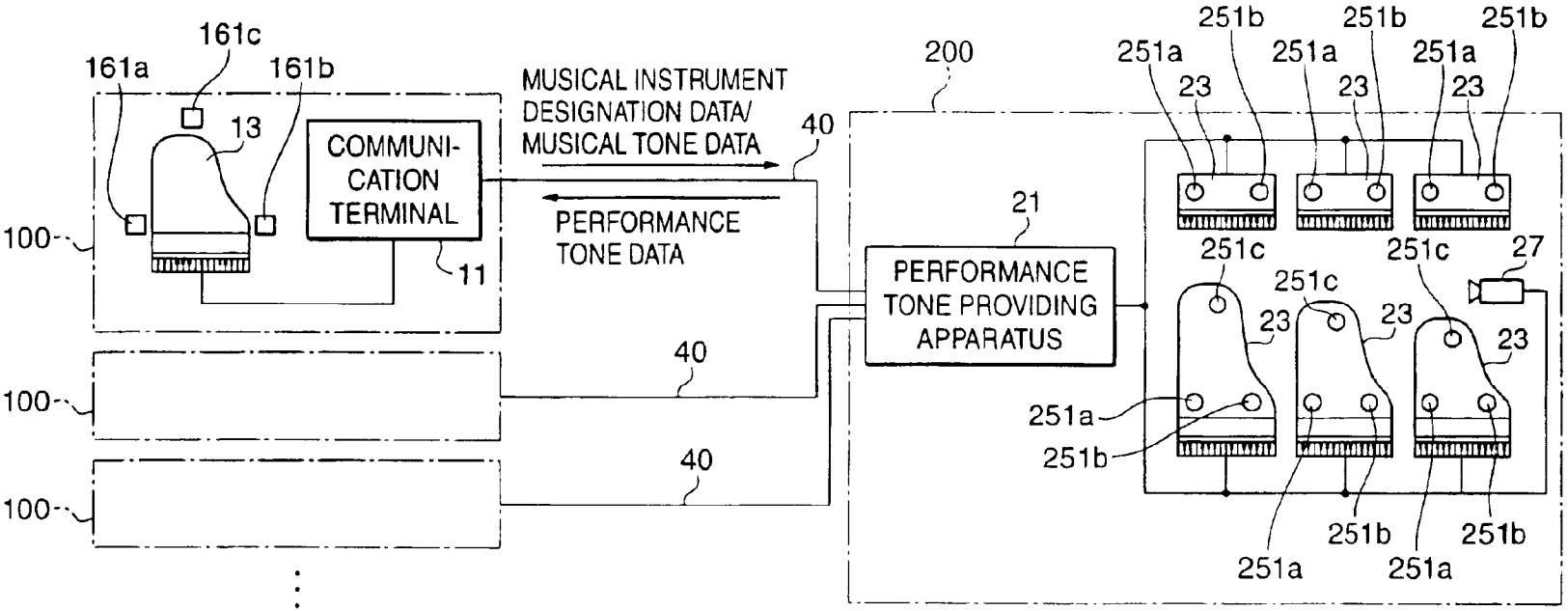
FIG. 1 is a block diagram showing the construction of a performance tone providing system according to a first embodiment of the present invention.

Referring first to FIG. 1, a description will be given of a performance tone providing system according to a first embodiment of the present invention in the case where it is used for selling musical instruments. As shown in FIG. 1, a communication terminal 11 and an electronic musical instrument 13 are installed in each of a plurality of musical instrument shops 100 located in many parts of the nation. Incidentally, although the communication 11 and the electronic music instrument 13 are illustrated for only one of the musical instrument shops 100, it is assumed that the communication terminal 11 and the electronic musical instrument 13 are also installed in other ones of the musical instrument shops 100. On the other hand, a management center 200 is a facility for providing musical tones sounded from a variety of musical instruments for users coming to the musical instrument shops 100. A performance tone providing apparatus 21 and a plurality of automatic performance musical instruments 23 for generating performance tones are installed in the management center 200. The performance tone providing apparatus 21 is connected to the respective communication terminals 11 of the musical instrument shops 100 via exclusive lines 40.

Figure 2:
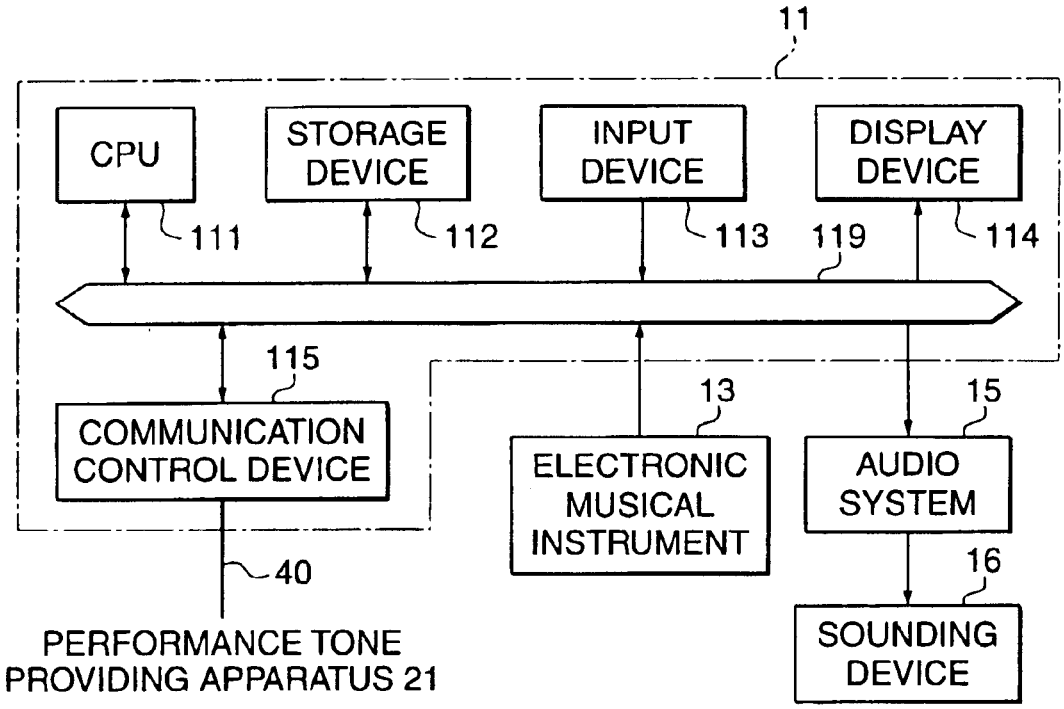
FIG. 2 is a block diagram showing the construction of a communication terminal in the performance tone providing system in FIG. 1.

FIG. 2 is a block diagram showing the construction of the communication terminal 11 installed in each of the musical instrument shops 100. As shown in FIG. 2, the communication terminal 11 is comprised of various component parts such as a CPU (Central Processing Unit) 111, a storage device 112, an input device 113, a display device 114, and a communication control device 115. These component parts are connected to a bus 119.

The CPU 111 executes programs stored in the storage device 112 and a ROM (Read Only Memory), not shown, to control the operations of the component parts of the communication terminal 11. The storage device 112 stores the programs to be executed by the CPU 111 and data to be used for executing the programs. For example, the storage device 112 is a hard disk drive. The input device 113 is comprised of a pointing device such as a mouse, and a keyboard for inputting characters and/or marks, and outputs signals according to user's operations to the CPU 111. The display device 114 is comprised of a CRT (Cathode Ray Tube) and a liquid crystal display panel, and displays a variety of images under the control of the CPU 111.

The communication control device 115 is for communicating with the performance tone providing apparatus 21 installed in the management center 200 via the exclusive line 40, and is comprised of a modem, for example. Specifically, the communication control device 115 transmits data supplied from the CPU 111 to the performance tone providing apparatus 21, and receives data transmitted from the performance tone providing apparatus 21 and outputs the same to the CPU 111.

Further, the electronic musical instrument 13 and an audio system 15 are connected to the communication terminal 11, and a sounding device 16 is connected to the communication terminal 11 via the audio system 15. The electronic musical instrument 13 is for generating data according to user's performing operation (hereinafter referred to as "musical tone data"). Specifically, the electronic musical instrument 13 is comprised of a plurality of operating elements respectively corresponding to different musical tones, and is operable in response to the user's operation of any of the operating elements, for outputting musical tone data corresponding to the operation to the CPU 111. As shown in FIG. 1, the electronic musical instrument 13 according to the present embodiment is a grand piano type keyboard instrument, which is operable in response to the depression or release of any key by the user, for outputting musical tone data corresponding to the operation.

The musical tone data according to the present embodiment conforms to the MIDI (Musical Instrument Digital Interface) standards. Specifically, upon depression of any key by the user, the electronic musical instrument 13 outputs musical tone data including a note-on event indicating the generation of a musical tone, a note number indicating the pitch of the musical tone corresponding to the depressed key, and a velocity indicating the intensity of the key depression. On the other hand, upon release of any depressed key by the user, the electronic musical instrument 13 outputs musical tone data containing a note-off event indicating the stop of a musical tone and a note number indicating the pitch of the musical tone. Each time the musical tone is outputted from the electronic musical instrument 13, the CPU 111 transmits the musical tone data from the communication control device 115 to the performance tone providing apparatus 21.

The audio system 15 and the sounding device 16 shown in FIG. 2 are for generating musical tones based on digital audio data supplied from the CPU 111. The audio system 15, not shown in FIG. 1, is comprised of a D/A (Digital/Analog) converter that converts digital audio data into an analog signal, and an amplifier that amplifies the analog signal. On the other hand, as shown in FIG. 1, the sounding device 16 is comprised of speakers 161 (161*a*, 161*b*, and 161*c*) that output musical tones according to the analog signal supplied from the audio system 15 via three channels. The speakers 161*a* and 161*b* are arranged at the left side and right side, respectively, of a keyboard of the electronic musical instrument 13 as viewed from the user. On the other hand, the speaker 161*c* is arranged at the rear of the speakers 161*a* and 161*b* as viewed from the user. It is to be understood, however, that the number of the speakers 161 constituting the sounding device 16 (i.e. the number of output channels) is not limited to three, but only one speaker (monaural output) or any other number of speakers may be provided. Further, either earphones or headphones that fit in or over the ears may be employed in place of the speakers 161 of the sounding device 16.

On the other hand, the performance tone providing apparatus 21 installed in the management center 200 is a computer system that receives musical tone data from the communication terminal 11 and transmits performance tone data corresponding to the musical tone data to the communication terminal 11. More specifically, the performance tone providing apparatus 21 causes any of a plurality of musical instruments to carry out automatic performance based on musical tone data received from the communication terminal 11, and transmits performance tone data representing musical tones sounded by the automatic performance to the communication terminal 11.

Figure 3:
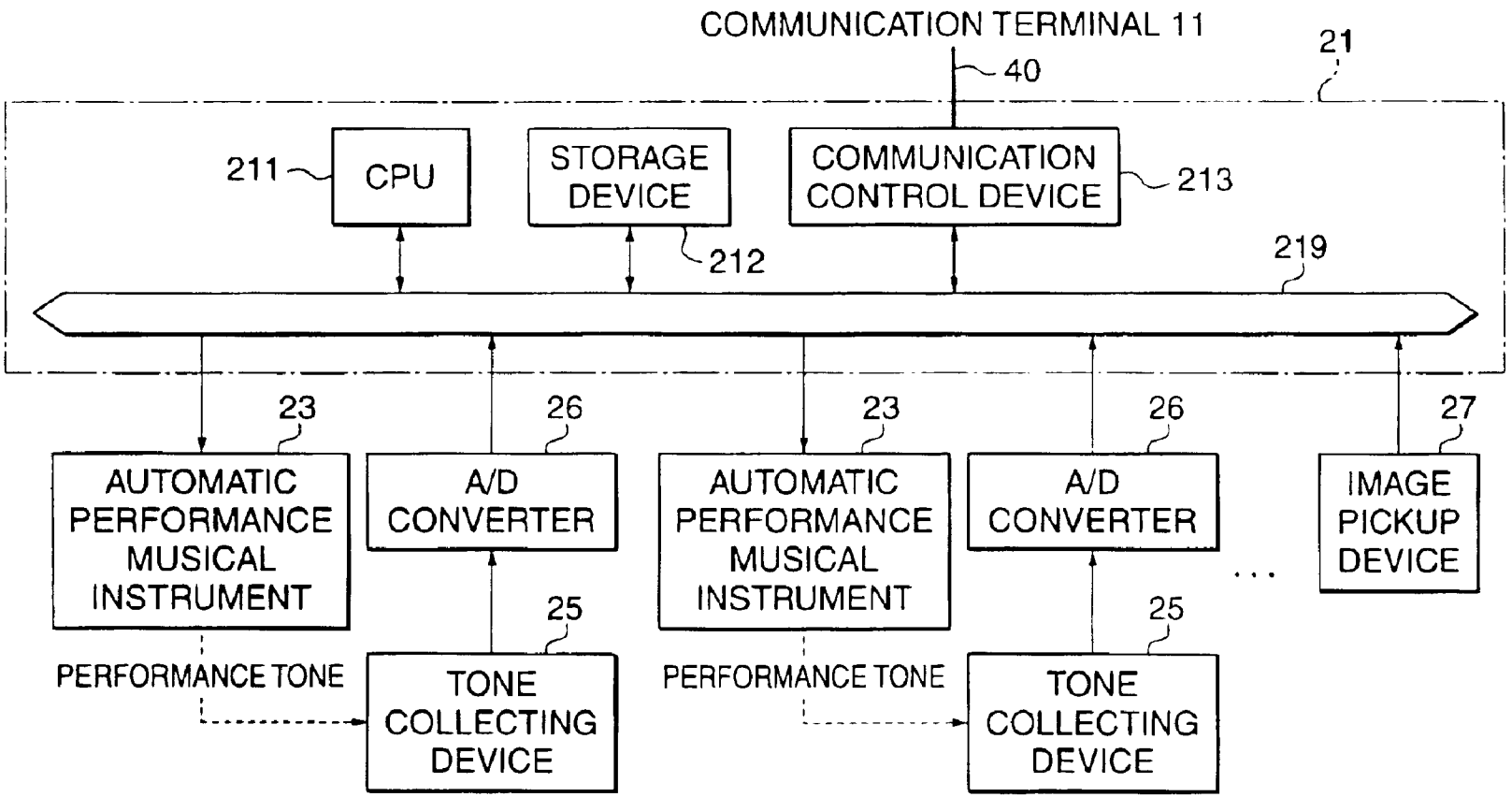
FIG. 3 is a block diagram showing the construction of a performance tone providing apparatus in the performance tone providing system in FIG. 1.

As shown in FIG. 3, the performance tone providing apparatus 21 is comprised of a CPU (Central Processing Unit) 211, a storage device 212, and a communication control device 213, which are connected to each other via a bus 219. The CPU 211 has a function of providing centralized control of component parts of the performance tone providing apparatus 21 by executing programs stored in the storage device 212. The storage device 212 is a hard disk drive, for example, which stores image data representing images to be displayed on the display device 114 of the communication terminal 11 as well as programs to be executed by the CPU 211.

The communication control device 213 is for communicating with the respective communication terminals 11 via the exclusive lines 40. Specifically, the communication control device 213 receives musical tone data transmitted from the communication terminal 11 and outputs the same to the CPU 211, and transmits performance tone data supplied from the CPU 211 to the communication terminal 11.

Further, a plurality of automatic performance musical instruments 23, an A/D (Analog/Digital) converter 26 to which are connected tone collecting devices 25 corresponding to the respective automatic performance musical instruments 23, and an image pickup device 27 are connected to the performance tone providing apparatus 21. The automatic musical instruments 23 carry out automatic performance based on musical tone data supplied from the communication terminal 11. In the present embodiment, it is assumed that three grand pianos of different types and three upright pianos of different types are installed as the automatic performance musical instruments 23 in the management center 200. In this case, each of the automatic performance musical instruments 23 is comprised of strings as a sounding source and a hammer mechanism that strikes any of the strings by driving any of a plurality of hammers according to musical tone data. With this arrangement, upon reception of musical tone data including a note-on event, for example, the automatic musical instrument 23 drives a hammer corresponding to a musical tone designated by a note number, thus generating the musical tone according to the striking of a string by the hammer.

The tone collecting devices 25 and the A/D converters 26 generate performance tone data corresponding to musical tones sounded from the automatic performance musical instruments 23. Each of the tone collecting devices 25 is comprised of a plurality of microphones 251 (251*a*, 251*b*, and 251*c*) incorporated in the corresponding automatic performance musical instrument 23. Each of the microphones 251 outputs an electric signal corresponding to musical tones sounded from the corresponding automatic performance musical instrument 23. As shown in FIG. 1, each of the grand piano type automatic performance musical instruments 23 is comprised of the microphone 251*a* and 251*b*, which are disposed in the vicinity of both ends of a keyboard as viewed from the user, and the microphone 251*c*, which is disposed at the rear of the microphones 251*a* and 251*b* as viewed from the user. On the other hand, each of the upright piano type automatic performance musical instruments 23 is comprised of the microphone 251*a* and 251*b*, which are disposed in the vicinity of both ends of the keyboard as viewed from the user. It should be noted that the number of the microphones 251 incorporated in the automatic performance musical instrument 23 (i.e. the number of input channels) is not limited to two or three, but only one microphone (monaural input) 251 or any other number of microphones 251 may be incorporated in the automatic performance musical instrument 23. Further, although it is assumed in the present embodiment that the microphones 251 are incorporated in the automatic performance musical instrument 23, the present invention is not limited to this, but a stand with a microphone may be placed at a location remote from the automatic performance musical instrument 23 to collect musical tones.

On the other hand, the A/D converters 26 shown in FIG. 3 output digital data obtained by sampling analog signals outputted from the tone collecting devices 25 at a predetermined frequency. The CPU 211 transmits the digital data outputted from the A/D converters 26 as performance tone data to the communication terminal 11.

The image pickup device 27 is a digital video camera, for example, which photographs the automatic performance musical instrument 23, which is carrying out automatic performance, and outputs image data representing an image (moving image or still image) thereof. The CPU 211 transmits the image data outputted from the image pickup device 27 to the communication terminal 11 via the communication control device 213. On the other hand, the communication terminal 11 causes the display device 114 to display the image represented by the image data.

Referring next to FIGS. 4 to 8, a description will be given of the operation of the performance tone providing system according to the present embodiment.

Figure 4:
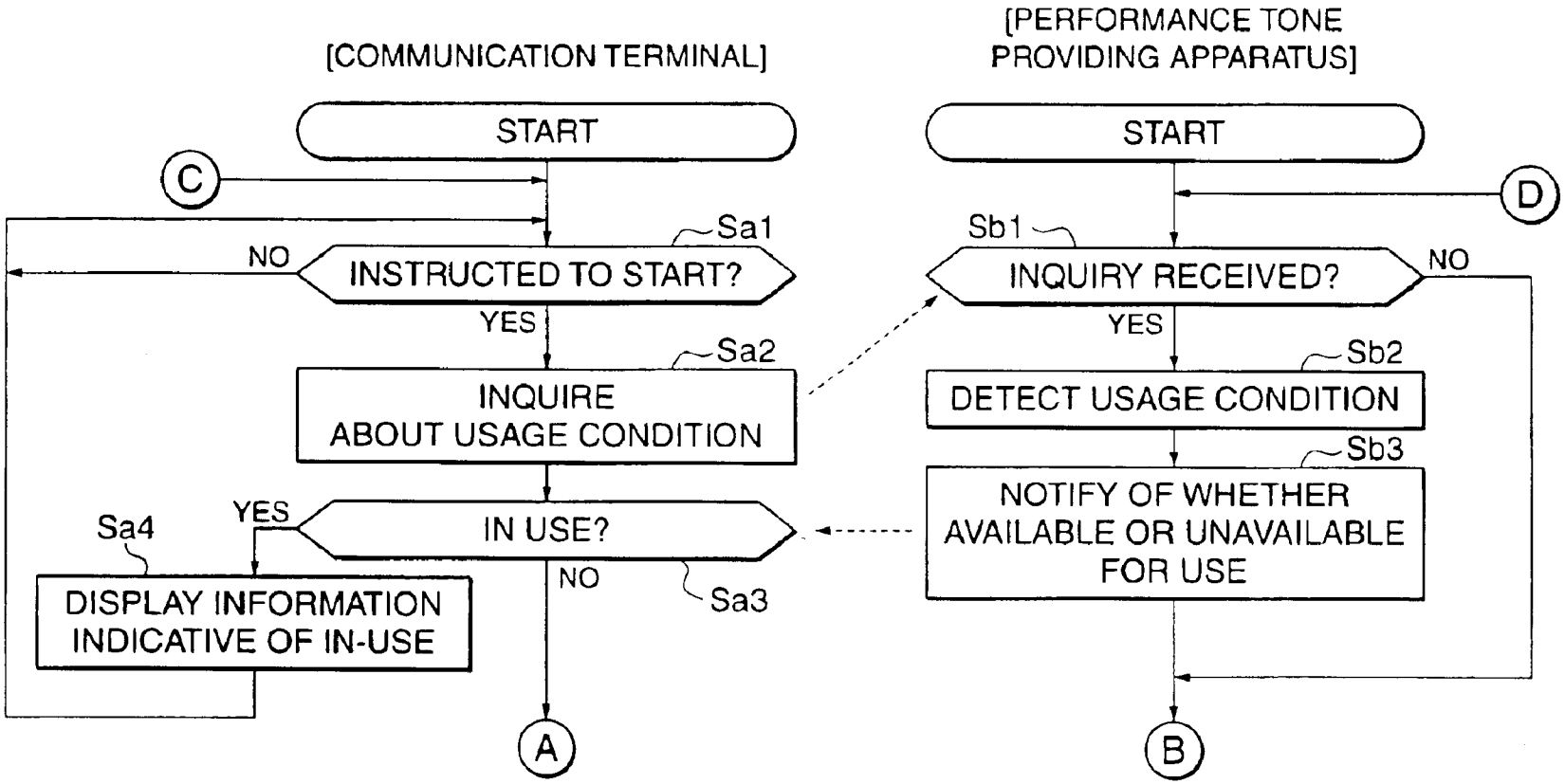
FIG. 4 is a flow chart useful in explaining the operation of the performance tone providing system in FIG. 1.
Figure 6:
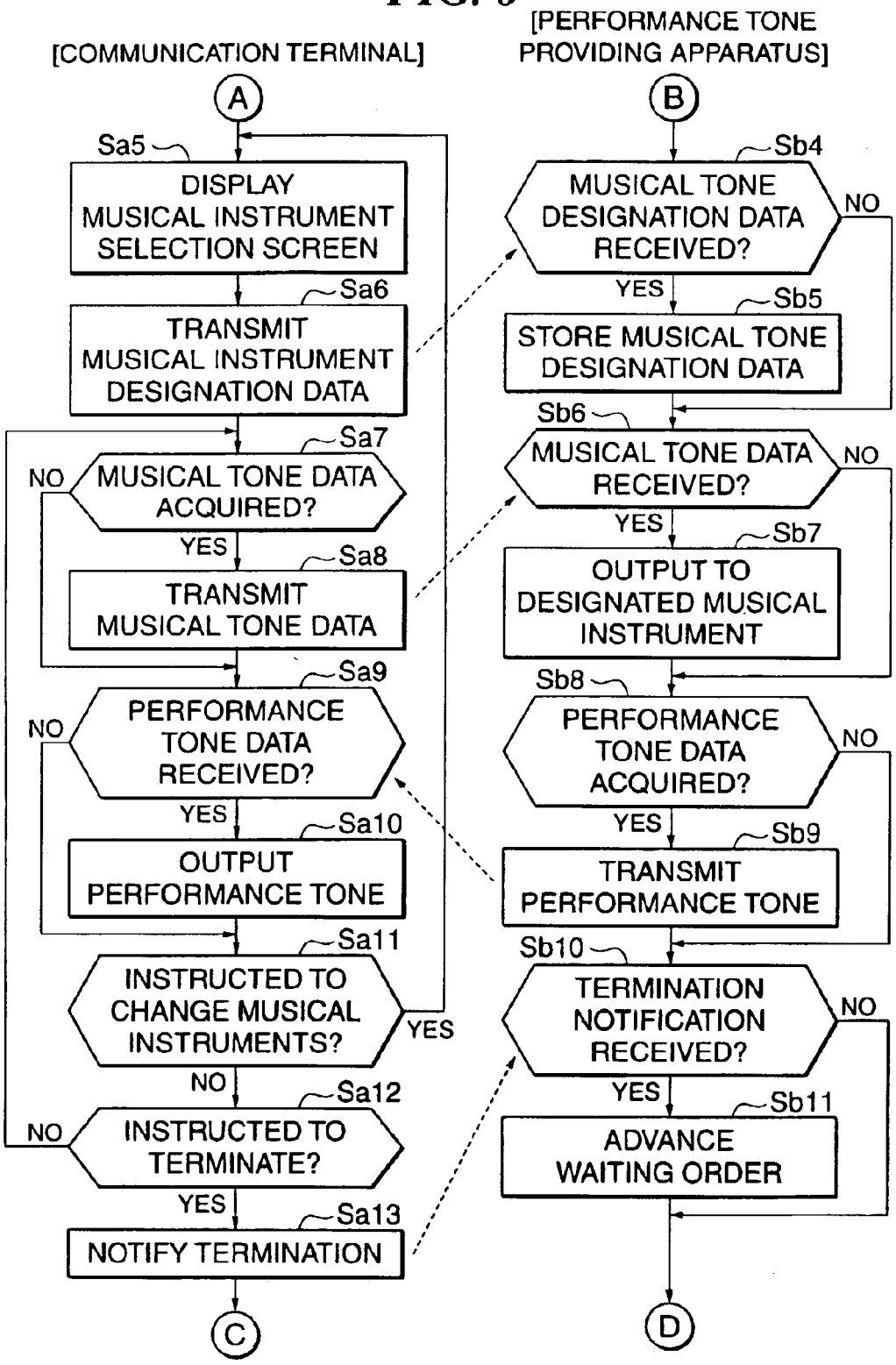
FIG. 6 is a flow chart useful in explaining the operation of the performance tone providing system in FIG. 1.

In response to turning-on of the power of the communication terminal 11 by an employee at the musical instrument shop 100, the CPU 111 of the communication terminal 11 executes a program stored in the storage device 112. The flow charts on the respective left sides of FIGS. 4 and 6 show the procedures for executing a main routine of the program. Likewise, in response to turning-on of the power of the performance tone providing apparatus 21 by an employee at the management center 200, the CPU 211 of the performance tone providing apparatus 21 executes a program stored in the storage device 212. The flow charts on the respective right sides of FIGS. 4 and 6 show the procedures for executing a main routine of the program.

First, the CPU 111 of the communication terminal 11 waits until the user coming to the musical instrument shop 100 operates the input device 113 in a predetermined way to give an instruction for starting performance (step Sa1). In response to this operation (step Sa1; Yes), the CPU 111 gives an instruction to the communication control device 115 to ask the performance tone providing apparatus 21 whether any of the automatic performance musical instruments 23 installed in the management center 200 is being used by the communication terminal 11 at any other musical instrument shop 100 (step Sa2).

On the other hand, the CPU 211 of the performance tone providing apparatus 21 determines in a step Sb1 whether an inquiry about the usage condition has been received from the communication terminal 11 or not. If it is determined in the step Sb1 that the inquiry about the usage condition has been received, the CPU 211 determines whether or not any of the automatic performance musical instruments 23 in the management center 200 is carrying out automatic performance at the present time point (step Sb2), and transmits the determination result to the communication terminal 11 having transmitted the inquiry (step Sb3). Specifically, when any of the automatic performance musical instruments 23 is being used, the CPU 211 transmits data indicative of this fact to the communication terminal 11, or transmits data indicative of this fact as well as data indicative of the musical instrument shop 100 where the user is present (refer to FIG. 5) to the communication terminal 11 in the case where there is a user who is waiting for the automatic performance musical instrument 23 to become available for use (step Sb3).

On the other hand, if it is determined in the step Sb2 that no automatic performance musical instrument 23 is being used, the CPU 211 transmits data indicative of this fact as well as detailed information relating to the automatic performance musical instruments 23 installed in the management center 200 (e.g. the specifications of the respective automatic performance musical instruments 23) and image data of images representing the appearances of the respective automatic performance musical instruments 23 to the communication terminal 11 (step Sb3). If there are a plurality of users who are waiting at the same time for the automatic performance musical instruments 23 to become available for use, the communication terminal 11 having transmitted the inquiry about the usage condition first among the communication terminals 11 installed in the musical instrument shops 100 where the plurality of users are present is selected as the destination.

On the other hand, the CPU 111 of the communication terminal 11 determines whether or not any of the automatic performance musical instruments 23 is being used at present according to the information supplied from the performance tone providing apparatus 21 (step Sa3). If it is determined in the step Sa3 that any of the automatic performance musical instruments 23 is being used, the CPU 111 causes the display device 114 to display a usage condition confirmation screen shown in FIG. 5 based on the data received from the performance tone providing apparatus 21 (step Sa4). This screen contains words representing the fact that the automatic performance musical instrument 23 in the management center 200 is being used, and words representing musical instrument shop(s) 100 where waiting user(s) is(are) present. Thereafter, the CPU 111 repeats the processing from the steps Sa1 to Sa4 until the other user has finished using the automatic performance musical instrument 23.

On the other hand, if no automatic performance musical instrument 23 in the management center 200 is being used (step Sa3; No), musical tone data and performance tone data are transmitted between the communication terminal 11 and the performance tone providing apparatus 21. This will now be described with reference to FIG. 6.

Figure 7:
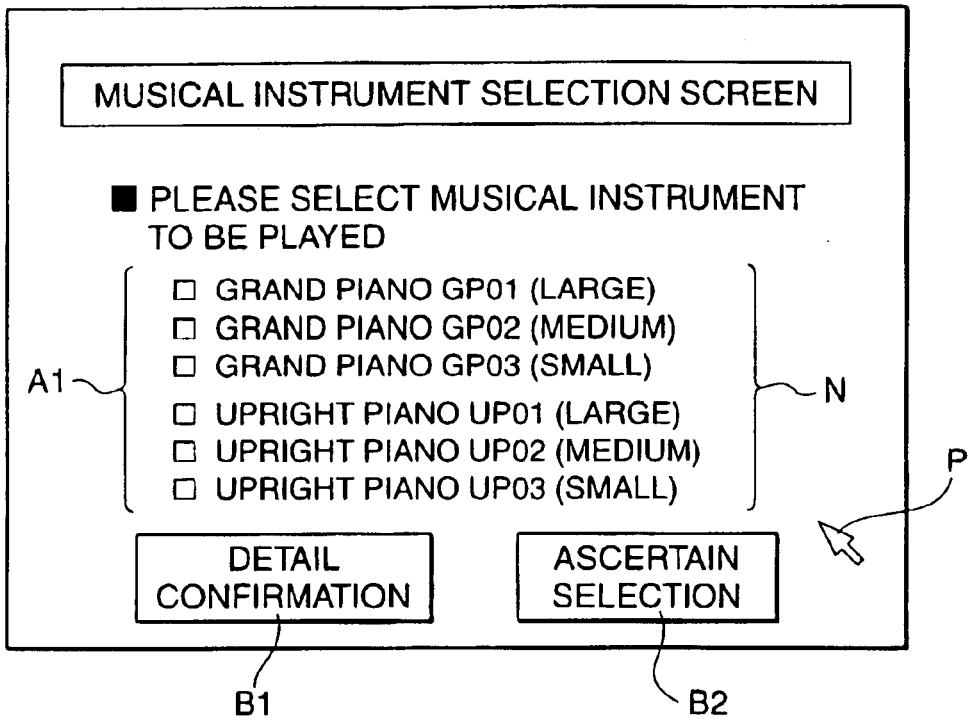
FIG. 7 is a view showing the contents of a musical instrument selection screen in the performance tone providing system in FIG. 1.

First, the CPU 111 of the communication terminal 11 causes the display device 114 to display a musical instrument selection screen shown in FIG. 7 according to information relating to the automatic performance musical instrument 23, which has been received from the performance tone musical instrument 21 in the step Sa3, and image data stored in the storage device 112 (step Sa5). This screen is intended to enable the user to select the automatic performance musical instrument 23 to be automatically played in generating performance tone data, and contains the names N of all of the automatic performance musical instruments 23 installed in the management center 200 (i.e. the automatic performance musical instruments 23 that may be selected by the user), and check areas A1 arranged at the left side of the respective names N. First, the user operates the mouse of the input device 113 to shift a pointer P into one check area A1 corresponding to one desired automatic performance musical instrument 23, and secondly, selects the desired automatic performance musical instrument 23 by depressing a button of the mouse. A check mark is displayed in the check area A1 to indicate that the corresponding automatic performance musical instrument 23 has been selected.

Further, the musical instrument selection screen contains a "detail confirmation" button B1 and an "ascertain selection" button B2. The "detail confirmation" button B1 is used to switch the display screen of the display device 114 to a detail confirmation screen. Specifically, in response to clicking on the "detail confirmation" button B1 by the user, the CPU 111 causes the display device 114 to display the detail confirmation screen shown in FIG. 8 in place of the musical instrument selection screen shown in FIG. 7. The detail confirmation screen contains detailed information relating to the automatic performance musical instruments 23 installed in the management-center 200, and more specifically, the detail confirmation screen contains a variety of information such as the sizes, weights, prices, etc. of the automatic performance musical instruments 23. Further, the detail confirmation screen contains a "next page" button B3. In response to clicking on the "next page" button B3 by the user, the CPU 111 causes the display device 114 to display a second page, not shown, containing images representing the appearances of the automatic performance musical instruments 23 indicated on the detail confirmation screen, in place of the screen shown in FIG. 8. Further, the second page also contains the "next page" button B3. In response to clicking on the "next page" button B3 by the user, the CPU 111 causes the display device 114 to display a third page, not shown, containing images including information relating to the other automatic performance musical instruments 23, which have not been selected. For example, information relating to three grand pianos is only displayed on the detail confirmation screen in FIG. 8. Thus, in response to clicking on the "next page" button B3 by the user, the CPU 111 causes the display device 114 to display the third page containing information relating to the other automatic performance musical instruments 23, i.e. three upright pianos. In response to clicking on the "next page" button B3 contained in the third page, the CPU 111 causes the display device 114 to display a fourth page, not shown, containing images representing the appearances of the three upright pianos in the same manner as described above. On the other hand, in response to clicking on an "end confirmation" button B4 contained in the detail confirmation screen by the user, the CPU 111 causes the display device 114 to display the musical instrument selection screen shown in FIG. 7 in place of the detail confirmation screen.

On the other hand, the "ascertain selection" button B2 in FIG. 7 is used to fix the selection of the automatic performance musical instrument 23. Specifically, in response to clicking on the "ascertain selection" button B2 by the user, the CPU 111 transmits musical instrument designation data, which specifies the automatic performance musical instrument 23 selected at the present time point (i.e. the automatic performance musical instrument 23 whose corresponding check area has been checked), to the performance tone providing apparatus 21 via the communication control device 115 (step Sa6). On the other hand, the CPU 211 of the performance tone providing apparatus 21 determines in a step Sb4 whether the musical instrument designation data has been received or not. If determining that the musical instrument designation data has been received, the CPU 211 causes the storage device 212 to store the received musical instrument designation data (step Sb5). On the other hand, if it is determined in the step Sb4 that the musical instrument designation data has not yet been received, the process proceeds to a step Sb6 with the step Sb5 being skipped.

On the other hand, after the selection of the automatic performance musical instrument 23, the user carries out performance by operating the keyboard of the electronic musical instrument 13 in an arbitrary manner. With the performance, the CPU 111 of the communication terminal 11 determines whether the electronic musical instrument 13 has outputted musical tone data or not (step Sa7). If determining that the electronic musical instrument 13 has outputted musical tone data, the CPU 111 transmits this musical tone data to the performance tone providing apparatus 21 (step Sa8). On the other hand, if it is determined in the step Sa7 that the electronic musical instrument 13 has not outputted musical tone data, the process proceeds to a step Sa9 with the step Sa8 being skipped. It should be noted that the musical tone data outputted from the electronic musical instrument 13 on this occasion is only transmitted to the performance tone providing apparatus 21 but musical tones based on the musical tone data is not sounded via the sounding device 16.

On the other hand, the CPU 211 of the performance tone providing apparatus 21 determines whether musical tone data has been received from the communication terminal 11 or not (step Sb6). If determining that musical tone data has been received from the communication terminal 11, the CPU 211 reads out the musical instrument designation data, which has been stored in the storage device 121 in the step Sb5, and outputs the received musical tone data to the automatic performance musical instrument 23 indicated by the musical instrument designation data (step Sb7). Consequently, the automatic performance musical instrument 23 having been supplied with the musical tone data carries out automatic performance. For example, if the musical tone data is comprised of a combination of a note-on event, a note number, and velocity, a hammer corresponding to a musical tone represented by the note number is actuated at an intensity corresponding to the velocity, so that the musical tone can be sounded in response to the striking of a string by the hammer. Then, performance tone data corresponding to the musical tone is generated by the tone collecting devices 25 and the A/D converters 26.

The CPU 211 then determines whether the A/D converter 26 has outputted performance tone data or not (step Sb8). If determining that the A/D converter 26 has outputted performance tone data, the CPU 211 transmits the performance tone data from the communication control device 213 to the communication terminal 11 (step Sb9). Further, if the image pickup device 27 has supplied image data to the CPU 211, the CPU 211 transmits this image data as well as the performance tone data to the communication terminal 11. On the other hand, if the CPU 211 determines in the step Sb8 that the A/D converter 26 has not outputted performance tone data, the process proceeds to a step Sb10 with the step Sb9 being skipped.

Incidentally, it may be configured such that before the transmission of performance tone data to the communication terminal 11, the performance tone data is corrected by the CPU 211 so as to compensate for a difference in position between the microphones 251 incorporated in the automatic performance musical instruments 23 and the speakers 161 arranged around the electronic musical instrument 13. Specifically, the sounding timing, volume, etc. of performance data acquired from each of the microphones 251 may be adjusted according to the positions of the microphones 251*a*, 251*b*, and 251*c* of the automatic performance musical instrument 23, and whether the microphone 251*c* is present or not, as well as according to the positions of the speakers 161*a*, 161*b*, and 161*c* (more particularly, the distance of the speaker 161*c* from a line connecting the speakers 161*a* and 161*b*) in the musical instrument shop 100, and whether the speaker 161*c* is present or not. For example, performance tone data acquired from the grand piano type automatic performance musical instrument 23 may be corrected in such a manner as to delay the sounding timing of performance tone data acquired from the microphone 251*c* relative to the sounding timing of performance data acquired from the microphones 251*a* and 251*b*. This enables the user, who is operating the electronic musical instrument 13, to listen to tones sounded from the speaker 161*a* arranged remote from the user in timing delayed from sounding of tones from the speakers 161*a* and 161*b* arranged close to the user. As a result, the performance of the musical instrument (the automatic musical instrument 23) carrying out automatic performance is reproduced more faithfully, and the user can listen to performed tones with depth and realistic sensations.

The CPU 111 of the communication terminal 11 determines in the step Sa9 whether performance tone data has been received from the performance tone providing apparatus 21 or not. If determining that performance tone data has been received from the performance tone providing apparatus 21, the CPU 111 outputs the performance tone data to the audio system 15 (step Sa10). Consequently, musical tones corresponding to the performance tone data are sounded via the sounding device 16. Further, if the CPU 111 has received image data as well as the performance tone data, it causes the display device 114 to display images corresponding to the image data, i.e. images representing the internal state of the management center 200. On the other hand, if the CPU 111 determines in the step Sa9 that performance tone data has not been received from the performance tone providing apparatus 21, the process proceeds to a step Sa11 with the step Sa10 being skipped.

Subsequently, the CPU 111 determines whether or not the input device 113 has been operated for the purpose of changing the automatic performance musical instrument 23 to be automatically played (step Sa11). If it is determined in the step Sa11 that the input device 113 has been operated for the purpose of changing the automatic performance musical instrument 23, the process then proceeds to the step Sa5. Specifically, the musical instrument selection screen shown in FIG. 7 is displayed on the display device 114 again, and the processing of the step Sa5 and subsequent steps is repeated. On the other hand, if it is determined in the step Sa11 that the input device 113 has not been operated for the purpose of changing the automatic performance musical instrument 23, the CPU 111 then determines whether or not the input device 113 has been operated for the purpose of terminating the performance (step Sa12). If the determination result is negative in the step Sa12, the process proceeds to the step Sa7. As a result, the processing of the steps Sa7 to Sa11 is repeated until the input device 113 is operated for the purpose of terminating the performance. Thus, each time the user operates the electronic musical instrument 13, musical tones sounded from the automatic musical instrument 23 in response to the operation are sounded via the sounding device 16.

On the other hand, if it is determined in the step Sa12 that the input device 113 has been operated for the purpose of terminating the performance, the CPU 111 informs the performance tone providing apparatus 21 that the performance using the automatic performance musical instrument 23 is to be terminated (step Sa13). Thereafter, the process proceeds to the step Sa1 to wait until the user instructs the CPU 111 to start performance.

On the other hand, upon receipt of information indicative of the termination of the performance from the communication terminal 11 (step Sb10; Yes), the CPU 211 of the performance tone providing apparatus 21 recognizes that the usage of the automatic performance musical instrument 23 by the communication terminal 11 has been brought to an end and then advances the order of the communication terminal(s) 11 currently waiting for the automatic performance musical instrument 23 to become available for use (step Sb11). Thereafter, upon receipt of the inquiry about the usage condition of the automatic performance musical instrument 23 again from the communication terminal 11 at the top of the waiting order in the step Sb1 in FIG. 4, the CPU 211 detects the present usage condition of the automatic performance musical instrument 23 (step Sb2). On this occasion, since the CPU 211 has recognized the termination of the usage of the automatic performance musical instrument 23 in the step Sb11, the CPU 211 transmits usage condition information indicative of the automatic performance musical instrument 23 being available for use to the communication terminal 11 (step Sb3).

On the other hand, if it is determined that the performance termination notification has not been received from the communication terminal 11 (step Sb10; No), the process proceeds to the step Sb1 in FIG. 4 with the step Sb11 being skipped. The processing of the steps Sb1 to Sb11 is then repeated until the performance termination notification is received from the communication terminal 11. Thus, each time musical tone data is received from the communication terminal 11, the automatic performance musical instrument 23 carries out automatic performance according to the musical tone data (step Sb7), and performance tone data representing musical tones sounded by the automatic performance are transmitted to the communication terminal 11 (step Sb9).

As described above, according to the present embodiment, the automatic performance musical instrument 23 installed in the management center 200 is caused to carry out automatic performance in response to the operation of the electronic musical instrument 13 at the musical instrument shop 100, and performance tones sounded from the automatic performance musical instrument 23 on this occasion are outputted via the sounding device 16 at the musical instrument shop 100. Therefore, even if a number of the automatic performance musical instruments 23 are not installed in the musical instrument shop 100, the user coming to the musical instrument shop 100 can listen to musical tones generated from the desired automatic performance musical instrument 23. Namely, the user can listen to musical tones, which would be sounded if he/she performed on the desired automatic performance musical instrument 23 by directly touching it. Further, if a space where the automatic performance musical instruments 23 are installed in the management center 200 has excellent sound effects, musical tones can be sounded via the sounding device 16 with excellent sound effects even if a space where the electronic musical instruments 13 are installed in the musical instrument shops 100 does not have excellent sound effects. In addition, installing a plurality of the automatic performance musical instruments 23 in the management center 200 enables the users to experience performance of the desired automatic performance musical instruments 23 (i.e. trial performance) even if a large number of the automatic performance musical instruments 23 are not installed in the respective musical instrument shops 100 located in many parts of the nation. This greatly reduces the cost required for sales of musical instruments.

Further, according to the present embodiment, the user can select, as desired, any one of a plurality of the automatic performance musical instruments 23 installed in the management center 200, and this is convenient for the user who wishes to select one to be purchased from among a large number of the automatic performance musical instruments 23.

Figure 8:
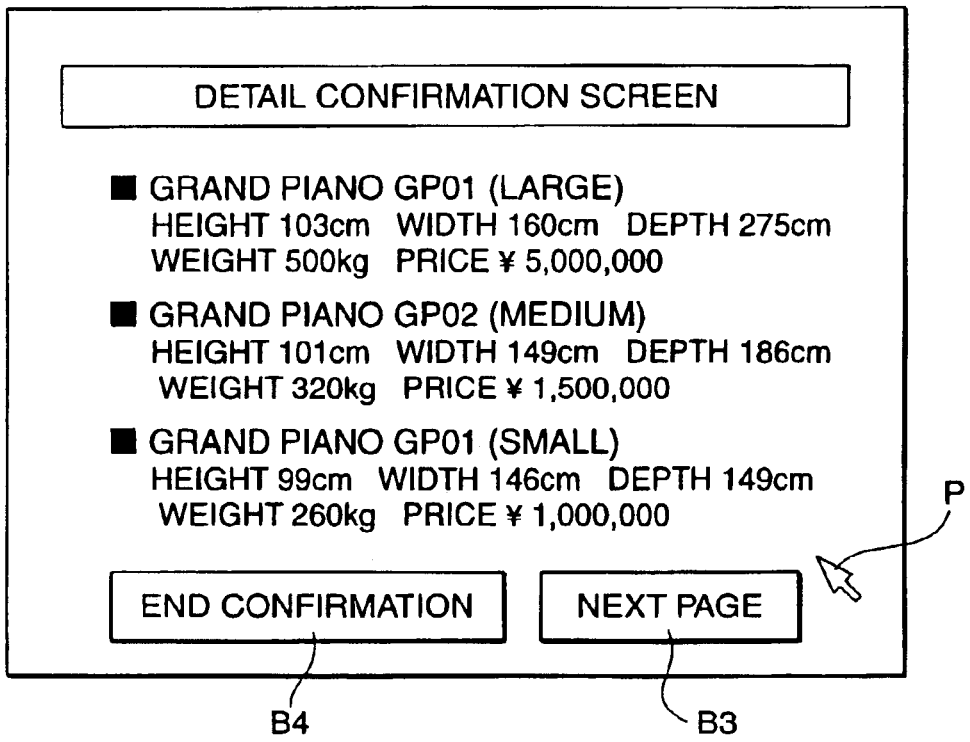
FIG. 8 is a view showing the contents of a detail confirmation screen in the performance tone providing system in FIG. 1.

Further, according to the present embodiment, when selecting the automatic performance musical instrument 23 to be played, the user can confirm detailed information on the respective musical instruments 23 by looking at the detail confirmation screen (FIG. 8). Further, since the condition of the automatic performance musical instrument 23 carrying out automatic performance is displayed on the display device 114, the user can confirm the movement of the keyboard and pedals of the automatic performance musical instrument 23 and the color and texture of the main body of the automatic performance musical instrument 23. Thus, according to the present embodiment, by referring to a variety of information relating to the automatic performance musical instruments 23 installed in the management center 200, the user can properly select a musical instrument to be purchased. Although in the present embodiment, the detail confirmation screen shown in FIG. 8 is displayed on the display device 114, the contents of the detail confirmation screen may be printed on a predetermined sheet by a printer. Further, the cost estimation for a musical instrument selected to be purchased by the user may be displayed on the display device 114, or may be printed on a predetermined sheet by a printer. This serves as a reference for the user in purchasing a musical instrument.

Although in the present embodiment, the management center 200 is continuously used by the communication terminal 11 until the performance termination notification is transmitted from the communication terminal 11 (step Sa12), the present invention is not limited to this, but it may be configured such that if the transmission of musical tone data from the communication terminal 11 is stopped for a longer period of time than a predetermined period of time, the usage of the management center 200 by the communication terminal 11 is forced to be terminated. This reduces a period of time for which the users of the other communication terminals 11 have to wait.

It should be understood that although the present invention is not limited to the above described first embodiment, various variations of the above described first embodiment may be possible without departing from the spirits of the present invention. For example, the following embodiments can be considered.

Although in the above described first embodiment, the performance tone providing system according to the present invention is used for sales of musical instruments, the present invention may be applied to various situations described below. It should be noted that elements and parts illustrated in drawings referred to below corresponding to those of the system according to the first embodiment shown in FIG. 1 referred to above are denoted by the same reference numerals.

Figure 9:
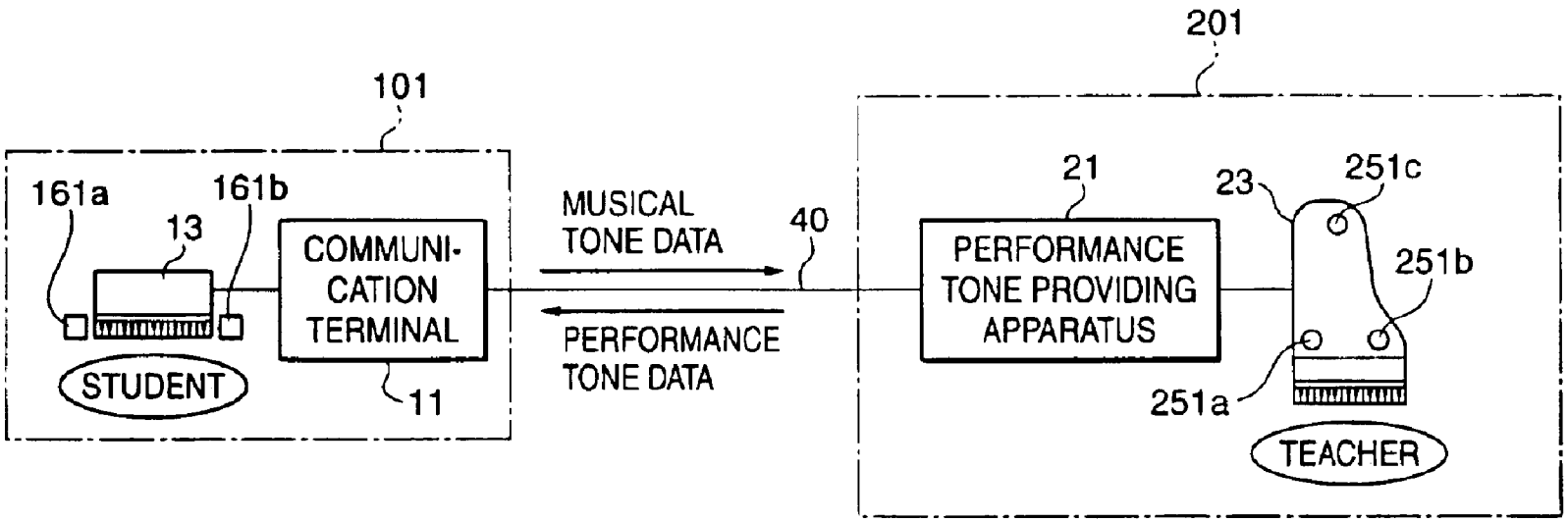
FIG. 9 is block diagram showing the construction of a performance tone providing system according to a second embodiment of the present invention.

A description will now be given of a second embodiment in which the present invention is applied as a system for teaching keyboard instruments to students. Specifically, as shown in FIG. 9, the communication terminal 11 and the electronic musical instrument 13 are installed in a room 101 (such as a student's home) where a student is present, and the performance tone providing apparatus 21 and the automatic performance musical instrument 23 are installed in a room 201 where a teacher is present. Musical tone data corresponding to the performance of the student on the electronic musical instrument 13 is transmitted from the communication terminal 11 to the performance tone providing apparatus 21, and performance data representing musical tones sounded from the automatic performance musical instrument 23 according to the musical tone data is transmitted from the performance tone providing apparatus 21 to the communication terminal 11 and outputted via the speakers 161.

With this arrangement, the student can listen to musical tones sounded from the automatic performance musical instrument 23 based on his/her performing operation. Further, words uttered by the teacher in the room 201 as well as musical tones are transmitted as performance tone data to the communication terminal 11 and outputted via the speakers 161. On the other hand, the teacher can evaluate the performance made by the student by listening to musical tones, which are sounded from the automatic performance musical instrument 23 in response to the student's performing operation. Namely, the student can be subjected to performance coaching at his/her home even if he/she does not have the expensive automatic performance musical instrument 23 used by the teacher. It should be noted that in the present embodiment, if the automatic performance musical instrument 23 installed in the room 201 is a musical instrument whose keys and pedals are operated based on musical tone data, the teacher can confirm the actions of the keys and pedals made in response to playing actions of the student, so that the teacher can provide more exact coaching.

Although in the above described first embodiment, a plurality of the automatic performance musical instruments 23 are installed in the management center 200, a plurality of the automatic performance musical instruments 23 should not necessarily be prepared for sounding musical tones as in the second embodiment but at least one musical instrument may suffice. Thus, the present invention does not essentially require a function of selecting any of a plurality of the automatic performance musical instruments 23 to output musical tone data.

Figure 10:
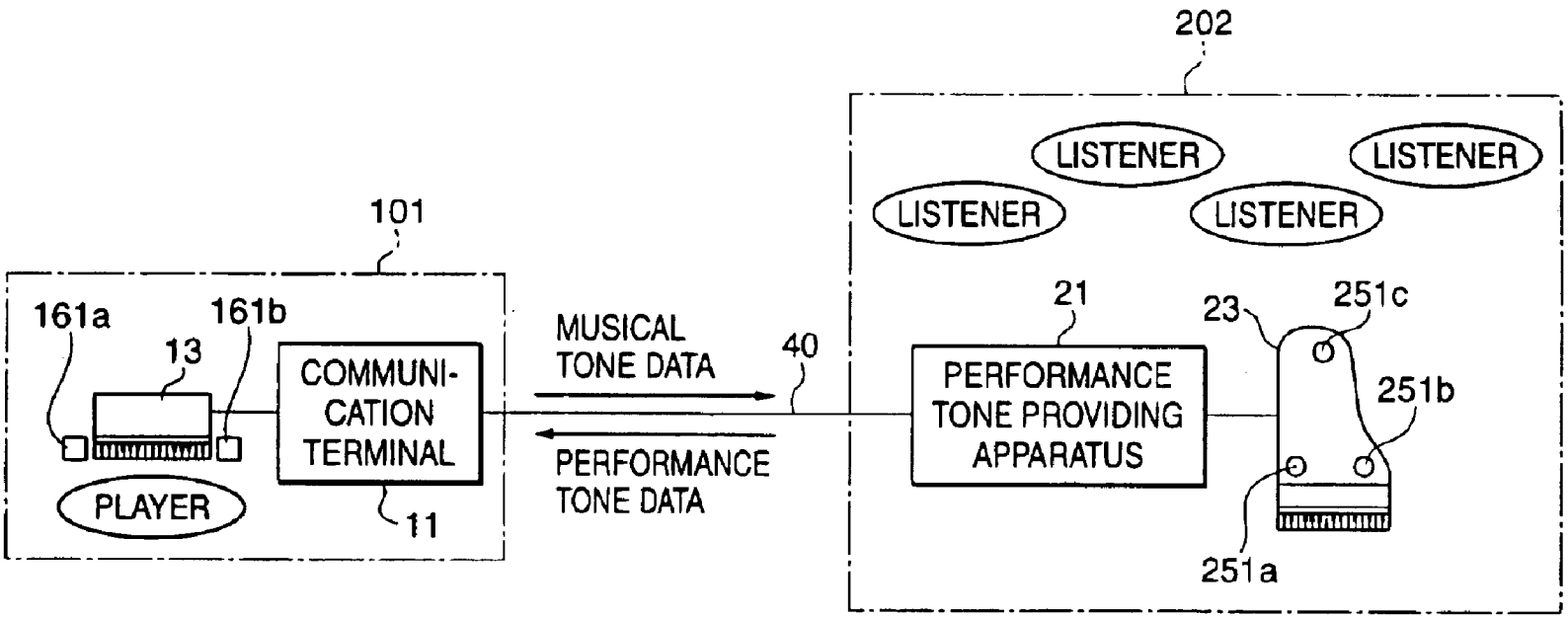
FIG. 10 is block diagram showing the construction of a performance tone providing system according to a third embodiment of the present invention.

A description will now be given of a third embodiment in which the present invention is applied as a system for a musical instrumental concert. Specifically, as shown in FIG. 10, the communication terminal 11 and the electronic musical instrument 13 are installed in a room 101 where a player is present, and the performance tone providing apparatus 21 and the automatic performance musical instrument 23 are installed in a concert hall 202 where listeners are present. Musical tone data according to the performance of the player on the electronic musical instrument 13 is transmitted from the communication terminal 11 to the performance tone providing apparatus 21, and performance tones corresponding to the musical tone data are sounded from the automatic performance musical instrument 23. The listeners in the concert hall 202 can enjoy music performed by the player by listening to the performance tones. On the other hand, the performance tone providing apparatus 21 transmits performance tone data corresponding to the performance tones sounded from the automatic performance musical instrument 23 to the communication terminal 11. As a result, the player can listen to the performance tones sounded via the speakers 16 based on the performance tone data. Namely, the player can make performance while confirming musical tones generated from the automatic performance musical instrument 23 based on his/her performing operation without actually coming to the concert hall 202.

Figure 11:
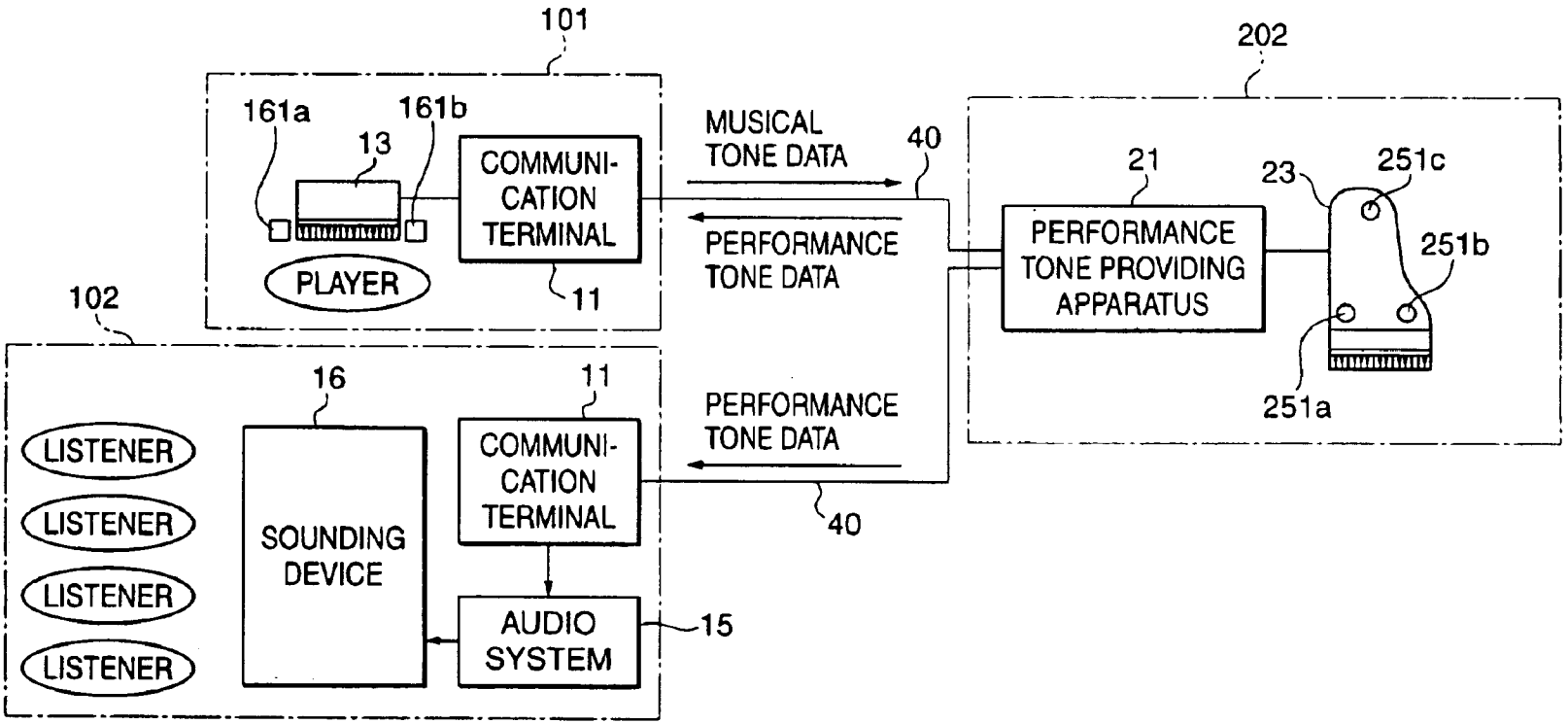
FIG. 11 is block diagram showing the construction of a performance tone providing system according to a fourth embodiment of the present invention.

Although in the third embodiment, the performance tone providing apparatus 21 and the automatic performance musical instrument 23 are installed in the convert hall 202 where the listeners are present, the listeners may listen to musical tones in a different place from the location where the performance tone providing apparatus 21 and the automatic performance musical instrument 23 are installed according to a fourth embodiment of the present invention. Specifically, as shown in FIG. 11, the communication terminal 11, audio system 15, and sounding device 16 are installed in a concert hall 102 where the listeners are present. Upon acquisition of performance tone data representing tones sounded from the automatic performance musical instrument 23 according to the performing operation of the player, the performance tone providing apparatus 21 transmits the performance tone data to the communication terminal 11 installed in the concert hall 102 in addition to the communication terminal 11 installed in the player's room 101. In the concert hall 102, the performance tone data received by the communication terminal 11 is sounded as musical tones via the audio system 15 and the sounding device 16, so that the listeners in the concert hall 102 can listen to musical tones sounded via the sounding device 16. In the fourth embodiment, the same effects as the above described third embodiment can be obtained.

As in the fourth embodiment, according to the present invention, the communication terminal 11 that transmits musical tone data and the communication terminal 11 that receives performance tone data should not necessarily be identical. For example, with the arrangement shown in FIG. 11, it may be arranged that the performance tone providing apparatus 21 transmits performance data to only the communication terminal 11 installed in the concert hall 102 without transmitting the same to the communication terminal 11 in the player's room 101.

Figure 12:
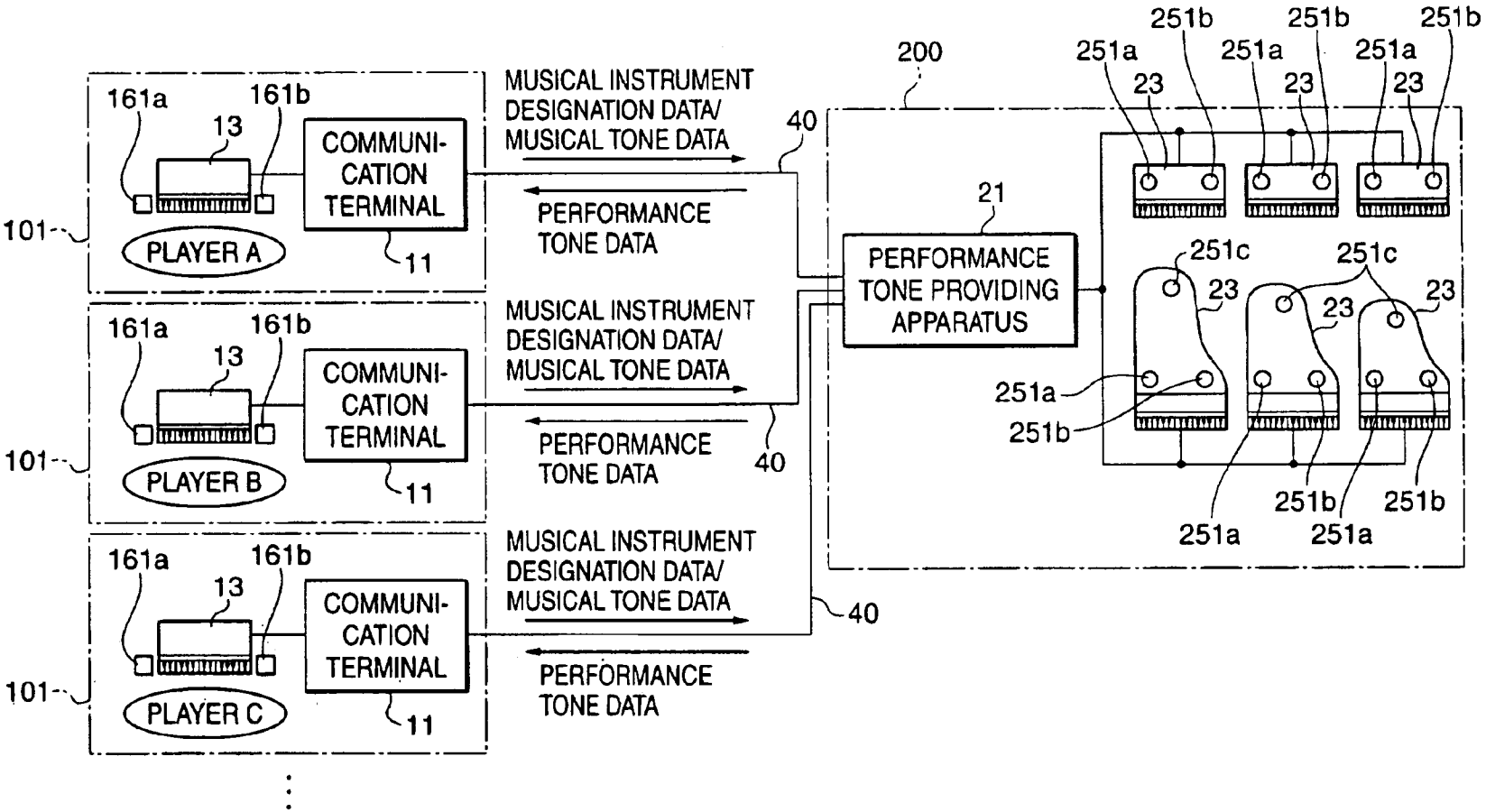
FIG. 12 is block diagram showing the construction of a performance tone providing system according to a fifth embodiment of the present invention.

A description will now be given of a fifth embodiment in which the present invention is applied as a system for a session performed by a plurality of players. Specifically, as shown in FIG. 12, the communication terminal 11 and the electronic musical instrument 13 are installed in each of a plurality of the rooms 101 where the respective players performing the session are present, and the performance tone providing apparatus 21 and a plurality of the automatic performance musical instruments 23 are installed in the management center 200. Musical tone data according to the performance of the players on the electronic musical instruments 13 are transmitted from the plurality of the communication terminals 11 to the performance tone providing apparatus 21, and musical tones corresponding to the musical tone data are sounded from the respective automatic performance musical instruments 23. It should be noted that the automatic performance musical instruments 23, to which the musical tone data are transmitted, are designated in advance such that they do not overlap with respect to a plurality of the players. For example, the large-sized grand piano 23 is designated for the player A, the small-sized grand piano 23 is designated for the player B, and the small-sized upright piano 23 is designated for the player C in FIG. 12. With this arrangement, musical tones are generated in parallel from a plurality of the automatic performance musical instruments 23 according to the performances of the respective players. The performance tone providing apparatus 21 generates performance tone data by adding together digital data received from the A/D converters 26 via the tone collecting devices 25 of the respective automatic performance musical instruments 23, and transmits the performance tone data to each of the plurality of the communication terminals 11. As a result, musical tones sounded from the sounding device 16 installed in each of the players' rooms are a mixture of musical tones sounded from the automatic performance musical instrument 23 in response to the performing operation of the player and musical tones sounded from the automatic performance musical instruments 23 in response to the performing operation of the other players. As described above, according to the fifth embodiment, a plurality of players can enjoy performing sessions even if they do not gather in one place.

Although in the above described first to fifth embodiments, each time the electronic musical instrument 13 is operated, musical tone data according to the operation is transmitted from the communication terminal 11 to the performance tone providing apparatus 21, it may be arranged that a file in the SMF (Standard MIDI File) format or the like (hereinafter referred to as "the musical tone file") is prepared in advance by playing the electronic musical instrument 13, and the communication terminal 11 reads in the musical tone file so as to successively transmit musical tone data stored in the musical tone file to the performance tone providing apparatus 21. Alternatively, it may be arranged that the musical tone file is transmitted from the communication terminal 11 to the performance tone providing apparatus 21, and the performance tone providing apparatus 21 successively outputs musical tone data stored in the musical tone file to the automatic performance musical instrument 23.

Further, although in the above described first to fifth embodiments, musical tone data conforms to the MIDI standards, the present invention is not limited to this. Specifically, musical tone data of any format may be used insofar as the musical tone data include data required for the musical instrument to carry out automatic performance. More specifically, according to the present invention, any musical tone data may be used insofar as it includes at least data specifying the pitch of musical tones.

Although in the above described first to fifth embodiments, the communication terminal 11 and the performance tone providing apparatus 21 are connected to each other via the exclusive line 40, the present invention is not limited to this. Specifically, the communication terminal 11 and the performance tone providing apparatus 21 may be connected to each other via a variety of communication networks such as the Internet and public telephone lines. Thus, the communication terminal 11 should not necessarily be installed in a special facility such as the musical instrument shop 100, but may be a personal computer or the like to which the electronic musical instrument 13 is connected. Further, the communication terminal 11 should not necessarily be connected by wire to the performance tone providing apparatus 21 over the communication path. For example, the communication terminal 11 may be a portable communication terminal that carries out communication through a wireless channel with a radio base station contained in a mobile communication network. Namely, according to the present invention, the communication terminal 11 and the performance tone providing apparatus 21 may by connected to each other in any way insofar as they can communicate with each other.

Further, although in the above described first to fifth embodiments, the user coming to the musical instrument shop 100 can listen to musical tones sounded from the automatic performance musical instrument 23, it may be additionally arranged that the user can offer a purchase of the automatic performance musical instrument 23 by using the communication terminal 11. A description will now be given of a concrete example thereof. First, the user operates the input device 113 of the communication terminal 11 in a predetermined manner, so as to designate the automatic performance musical instrument 23 to be purchased and inputs the number of a credit card to be used for the payment. Then, upon recognition of the input, the performance tone providing apparatus 21 notifies a terminal device, which is managed by a financial company such as a bank, of the price of the automatic performance musical instrument 23 to be purchased, and requests confirmation of the credit card number. When notified by the financial company to the effect that the confirmation and the payment have been properly completed, the performance tone providing apparatus 21 displays the notification on the display device 114 of the communication terminal 11. The ordered automatic performance musical instrument 23 is then shipped to the user by a musical instrument seller. With this arrangement, the user who wishes to purchase a musical instrument can properly select a desired musical instrument by listening to musical tones sounded from the automatic performance musical instrument 23 and can also purchase a desired musical instrument by an extremely simple procedure.

Further, although in the above described first to fifth embodiments, performance tone data is generated using the automatic performance musical instrument 23 having the automatic performance function, a musical instrument used for generating performance tone data should not necessarily have the automatic performance function incorporated therein. For example, it is assumed that a keyboard instrument, which does not have the automatic performance function, is used as a musical instrument for generating performance tone data. In this case, the keyboard instrument may be automatically played by mounting an automatic performance device on a keyboard of the keyboard instrument. Specifically, the automatic performance device is comprised of pressing members, which are provided correspondingly to respective keys and are capable of moving in such as way as to depress the keys, and a mechanism that actuates any of the pressing members according to musical tone data. By using this kind of automatic performance device, even if a natural musical instrument which does not have the automatic performance function is used as a musical instrument for acquiring performance tones, it is possible to generate performance tone data according to musical tone data composed of acoustic tones generated by the natural musical instrument. For example, it is possible to generate performance tone data using a musical instrument with an antique value, a musical instrument with a historic or materialistic value (for example, a pipe organ installed in a church), or the like.

Further, although in the above described first to fifth embodiments, the keyboard instrument is used as a musical instrument for generating performance tones, performance tone data may be generated based on performance tones sounded from other musical instruments. Namely, according to the present invention, any types of musical instruments may be used for generating performance tone data insofar as they are actuated to sound musical tones automatically based on musical tone data, that is, without involving the user's performing operation.

Further, although in the above described first to fifth embodiments, digital data is obtained by sampling an analog signal outputted from the collecting device 25 at a predetermined frequency by the A/D converter 26 and the digital data itself is transmitted as performance tone data to the communication terminal 11, audio data in a compressed format such as MP3 data may be transmitted as performance tone data in place of the digital data itself to the communication terminal 11.

It is to be understood that the object of the present invention may also be accomplished by a program executed by a computer that carries out communication with a communication terminal via a network. Specifically, the program is comprised of the following modules to be executed by the computer: a receiving module for receiving musical tone data including data specifying the pitch of musical tones from the communication terminal, an automatic performance module for causing a predetermined musical instrument to carry out automatic performance based on the received musical tone data, and a transmitting module for transmitting performance tone data representing musical tones sounded from the predetermined musical instrument by the automatic performance to the communication terminal.

It is to be understood that the object of the present invention may also be accomplished by a program executed by a computer that carries out communication with a performance tone providing apparatus via a network. Specifically, the program is comprised of the following modules to be executed by the computer: a transmitting module for transmitting musical tone data including data specifying the pitch of musical tones to the performance tone providing apparatus, and a receiving module for receiving performance tone data representing musical tones sounded from a predetermined musical instrument automatically played based on the transmitted musical tone data to the performance tone providing apparatus.

It is also to be understood that the object of the present invention may also be accomplished by a computer-readable storage medium storing the above described program. Examples of the storage medium storing the above described program include a ROM, a floppy (registered trademark) disk, a hard disk, an optical disk, a magnetic-optical disk, a CD-ROM, a CD-R, a CD-RW, a DVD-ROM, a DVD-RAM, a DVD-RW, a DVD+RW, a magnetic tape, a nonvolatile memory card, or the like.

What is claimed is:

1. A performance tone providing apparatus comprising:

a receiving device that receives musical tone data including data specifying pitch of musical tones from a first communication terminal;

a controller that causes a predetermined musical instrument to carry out automatic performance based on the musical tone data received by said receiving device;

a performance data generating device that generates performance tone data by sampling musical tones sounded from the predetermined musical instrument by the automatic performance; and a transmitting device that transmits the performance tone to a second communication terminal.

2. A performance tone providing apparatus according to claim 1, wherein said performance data generating device generates the performance tone data by sampling musical tones sounded from a musical instrument designated by the first communication terminal among a plurality of musical instruments prepared in advance.

3. A performance tone providing apparatus according to claim 2, wherein the plurality of musical instruments comprise automatic performance pianos.

4. A performance tone providing apparatus according to claim 1, wherein each time said receiving device receives the musical tone data from the first communication terminal, said controller causes the predetermined musical instrument to carry out automatic performance based on the received musical tone data.

5. A performance tone providing apparatus according to claim 1, wherein the second communication terminal is identical with the first communication terminal.

6. A performance tone providing apparatus according to claim 1, wherein the second communication terminal is different from the first communication terminal.

7. A performance tone providing apparatus according to claim 1, wherein the predetermined musical instrument is an acoustic musical instrument, and said performance tone data generating device generates as the performance tone data digital audio data generated by A/D conversion from acoustic tones generated by the automatic performance of the predetermined musical instrument.

8. A performance tone providing apparatus according to claim 1, wherein the second communication terminal reproduces the performance tone data as audio data.

9. A communication terminal comprising:

a transmitting device that transmits musical tone data including data specifying pitch of musical tones to a performance tone providing apparatus; and a receiving device that receives performance tone data generated by sampling musical tones sounded from a predetermined musical instrument when the predetermined musical instrument is caused to carry out automatic performance based on the musical tone data transmitted from said transmitting device, from the performance tone providing apparatus.

10. A performance tone providing apparatus according to claim 9, wherein the predetermined musical instrument comprises an automatic performance piano.

11. A communication terminal according to claim 9, comprising a controller that provides control such that the performance tone data received by said receiving device is supplied to a tone outputting device capable of outputting musical tones according to the performance tone data.

12. A communication terminal according to claim 9, wherein said transmitting device transmits musical tone data outputted from an electronic musical instrument that generates the musical tone data including data specifying pitch of musical tones according to a user's operations, to the performance tone providing apparatus.

13. A performance tone providing apparatus according to claim 9, wherein the predetermined musical instrument is an acoustic musical instrument, and the performance tone data comprises digital audio data generated from acoustic tones generated by the automatic performance of the predetermined musical instrument.

14. A performance tone providing apparatus according to claim 9, wherein the communication terminal reproduces the performance tone data as audio data.

15. A performance tone providing system comprising:

an electronic musical instrument that outputs musical tone data including data specifying pitch of musical tones according to user's operations;

a first communication terminal that transmits the musical tone data outputted from said electronic musical instrument;

a musical instrument that carries out automatic performance based on musical tone data;

a tone collecting device that generates performance tone data by sampling musical tones sounded from said musical instrument; and a performance tone providing apparatus that causes said musical instrument to carry out the automatic performance based on the musical tone data transmitted from said communication terminal, and transmits the performance tone data generated by said tone collecting device according to the automatic performance to a second communication terminal.

16. A performance tone providing system according to claim 15, wherein the second communication terminal is identical with the first communication terminal.

17. A performance tone providing system according to claim 15, wherein the second communication terminal is different from the first communication terminal.

18. A performance tone providing method executed by a computer, which communicates with first and second communication terminals, comprising:

a receiving step of receiving musical tone data including data specifying pitch of musical tones from the first communication terminal;

an automatic performance step of causing a predetermined musical instrument to carry out automatic performance based on the musical tone data received in said receiving step;

a performance data generating step of generating performance tone data by sampling musical tones sounded from the predetermined musical instrument in said automatic performance step; and a transmitting step of transmitting the performance tone to a second communication terminal.

19. A performance tone providing method according to claim 18, wherein said performance data generating step comprises generating the performance data by sampling musical tones sounded from a musical instrument designated by the first communication terminal among a plurality of musical instruments prepared in advance.

20. A performance tone providing method according to claim 19, wherein the plurality of musical instruments comprise automatic performance pianos.

21. A performance tone providing method according to claim 18, wherein each time the musical tone data is received from the first communication terminal in said receiving step, in said automatic performance step, the predetermined musical instrument is caused to carry out automatic performance based on the received musical tone data.

22. A performance tone providing method according to claim 18, wherein the second communication terminal is identical with the first communication terminal.

23. A performance tone providing method according to claim 18, wherein the second communication terminal is different from the first communication terminal.

24. A performance tone providing method according to claim 18, wherein the predetermined musical instrument is an acoustic musical instrument, and said performance tone data generating step comprises generating as the performance tone data digital tone data generated by A/D conversion from acoustic tones generated by the automatic performance of the predetermined musical instrument.

25. A performance tone providing apparatus according to claim 18, wherein the second communication terminal reproduces the performance tone data as audio data.

26. A program executed by a computer, which communicates with first and second communication terminals, comprising:

a receiving module for receiving musical tone data including data specifying pitch of musical tones from the first communication terminal;

an automatic performance module for causing a predetermined musical instrument to carry out automatic performance based on the received musical tone data;

a performance data generating module for generating performance tone data by sampling musical tones sounded from the predetermined musical instrument by said automatic performance module;

a transmitting module for transmitting the performance tone to a second communication terminal.

27. A program executed by a computer, which communicates with a performance tone providing apparatus, comprising:

a transmitting module for transmitting musical tone data including data specifying pitch of musical tones to the performance tone providing apparatus; and a receiving module for receiving performance tone data generated by sampling musical tones sounded from a predetermined musical instrument when the predetermined musical instrument is caused to carry out automatic performance based on the transmitted musical tone data, from the automatic performance providing apparatus.

28. A computer-readable storage medium storing a program executed by a computer, which communicates with a performance tone providing apparatus, comprising:

a receiving module for receiving musical tone data including data specifying pitch of musical tones from a first communication terminal;

an automatic performance module for causing a predetermined musical instrument to carry out automatic performance based on the received musical tone data;

a performance data generating module for generating performance tone data by sampling musical tones sounded from the predetermined musical instrument by said automatic performance module;

a transmitting module for transmitting the performance tone to a second communication terminal.

29. A computer-readable storage medium storing a program executed by a computer, which communicates with a performance tone providing apparatus, comprising:

a transmitting module for transmitting musical tone data including data specifying pitch of musical tones to the performance tone providing apparatus; and a receiving module for receiving performance tone data generated by sampling musical tones sounded from a predetermined musical instrument when the predetermined musical instrument is caused to carry out automatic performance based on the transmitted musical tone data, from the automatic performance providing apparatus.

* * * * *